US009279639B2

(12) United States Patent
Hines

(10) Patent No.: US 9,279,639 B2
(45) Date of Patent: Mar. 8, 2016

(54) POWERED FORWARD MODULE

(71) Applicant: Stephen Charles Hines, Edgewood, NM (US)

(72) Inventor: Stephen Charles Hines, Edgewood, NM (US)

( * ) Notice: Subject to any disclaimer, the term of this patent is extended or adjusted under 35 U.S.C. 154(b) by 208 days.

(21) Appl. No.: 13/800,887

(22) Filed: Mar. 13, 2013

(65) Prior Publication Data

US 2015/0241166 A1 Aug. 27, 2015

Related U.S. Application Data

(60) Provisional application No. 61/610,281, filed on Mar. 13, 2012, provisional application No. 61/778,407, filed on Mar. 12, 2013.

(51) Int. Cl.

| | |
|---|---|
| ***F41C 23/16*** | (2006.01) |
| ***F41C 23/22*** | (2006.01) |
| ***F41G 11/00*** | (2006.01) |

(52) U.S. Cl.

CPC ..... *F41C 23/22* (2013.01); *F41C 23/16* (2013.01); *F41G 11/003* (2013.01)

(58) Field of Classification Search

None

See application file for complete search history.

(56) References Cited

U.S. PATENT DOCUMENTS

| | | | | |
|---|---|---|---|---|
| 5,392,550 | A * | 2/1995 | Moore et al. | 42/117 |
| 7,627,975 | B1 * | 12/2009 | Hines | 42/84 |
| 8,091,265 | B1 * | 1/2012 | Teetzel et al. | 42/72 |
| 2010/0175293 | A1 * | 7/2010 | Hines | 42/71.01 |
| 2010/0192446 | A1 | 8/2010 | Darian | |
| 2010/0192448 | A1 | 8/2010 | Darian | |
| 2010/0275489 | A1 * | 11/2010 | Cabahug et al. | 42/71.01 |
| 2011/0000120 | A1 | 1/2011 | Thompson | |
| 2011/0192066 | A1 * | 8/2011 | Kimmel et al. | 42/71.01 |

FOREIGN PATENT DOCUMENTS

WO WO 2009/082520 A2 * 7/2009

* cited by examiner

*Primary Examiner* — Stephen M Johnson

(74) *Attorney, Agent, or Firm* — Richard H. Krukar; Luis M. Ortiz; Kermit D. Lopez

(57) ABSTRACT

A firearm can have a handguard having an inner section and an outer section with the outer section having circuitry and control devices for controlling electronic devices. The electronic devices can be part of the outer section. The inner section attaches to the firearm similarly to a current art handguard. The outer section attaches to the inner section. Different functionality can be obtained through the attachment of different outer sections to the inner section. The outer section can obtain electrical power from a power supply attached to or integrated with the firearm. The outer section can alternatively receive electrical power from a power supply carried by a person in a back pack or vest.

17 Claims, 6 Drawing Sheets

POWERED FORWARD MODULE

CROSS-REFERENCE TO RELATED APPLICATIONS

This application claims the benefit and priority of U.S. Provisional Patent Application 61/610,281 titled "Powered Forward Module" and filed on Mar. 13, 2012 and of U.S. Provisional Patent Application 61/778,407 titled "Powered Forward Module" and filed on Mar. 12, 2013 both of which are herein included by reference in their entirety.

TECHNICAL FIELD

Embodiments are generally related to firearms, Picatinny rails, firearm rail systems, batteries, and firearm accessories.

BACKGROUND OF THE INVENTION

Firearms, particularly military style carbines and rifles, are often outfitted with rail systems. Historically, Picatinny rails were attached to or formed into the upper receivers of M-16 style firearms to which sights such as scopes, red dots, and even iron sights have been mounted. Over time, more and more mounting rails have been added with current models having mounting rails on the receiver and four mounting rails on the forward hand guard. The reason is that a vast number of rail mountable firearm accessories have become available. Examples of these firearms accessories include the aforementioned sights as well as lasers, flashlights, bayonets, grenade launchers, sling swivels, cameras, bipods, vertical fore grips, and other items.

A number of the firearm accessories are electrically powered. Many solutions simply include battery compartments. For example, a flashlight accessory is basically a battery powered flashlight with rail compatible mount points. More recently, solutions are being developed for electrifying the firearms and rail systems. Hines (U.S. Pat. No. 7,627,975) and Thompson (US Patent Application 2011/0000120) teach bringing electrical power to forward mounted accessories. Darian (US Patent Applications 2010/0192446, 2010/0192448, and 2011/0131858) also teaches powering firearm accessories from a firearm rail. Such rails can be referred to as empowered mounting rails.

Current small arms use mounting rail systems for attaching accessories to the small arm. For example, M4 and M16 carbines are often fitted with a single piece handguard that incorporates up to four Picatinny rails. Picatinny rails are well known mounting rails that meet the specifications contained in MIL-STD-1913 and MIL-STD-1913 Notice 1. Another mounting rail called the Weaver rail is a notoriously well known variation of the Picatinny rail. Battaglia discloses a mounting rail system in U.S. Pat. No. 6,792,711 while Olson discloses another in U.S. Pat. No. 5,826,363.

FIG. 1, labeled as "Prior Art", illustrates an M16 type firearm 101 with mounting rails 106. The specific rifle is a flat top model having a mounting rail 106 on the upper receiver 102 as well as the four on the handguard 105. As is standard for M16 type firearms, the handguard 105 is attached to the firearm by being pushed into a front handguard cup 104 by a delta ring 103. The illustrated handguard 101 has four non-powered mounting rails 106 of which three are visible. A number of accessories have been developed to attach to small arms by way of mounting rails 106. The mounting rails have recoil grooves that help lock accessories in place and help users attach accessories in repeatable positions. Note that the term "firearm" used here and throughout this document is intended to include firearm replicas. In general, firearm replicas are toys or models that look substantially like fully functioning firearms and are designed to accommodate the same firearm accessories as those used with fully functional firearms. As such, FIG. 1 can also be a picture of a firearm replica.

FIG. 2, labeled as "Prior Art", illustrates a barrel nut 201 having a barrel nut sprocket 202. The barrel nut sprocket 202 has numerous teeth 203 that can provide a gripping surface for turning the barrel nut 201. As is well known by those familiar with modern firearms, the barrel nut attaches the barrel to the upper receiver. Many current handguards are "free floating" in that they attach to the barrel nut but do not touch the barrel.

FIG. 3, labeled as "Prior Art", illustrates a barrel nut 201 attaching a barrel 301 to a firearm receiver 102. The barrel nut 201 is tightened onto the receiver 102 by gripping the barrel nut sprocket 202 and twisting. A special tool is often used to tighten the barrel nut 201 until the barrel nut 201 and the barrel 301 are firmly attached to the receiver 102.

Many of the current art electrified rail systems use powered firearm mounting rails that conduct electrical energy from an electrical input connection to one or more rail mounted devices. Systems and methods providing alternative methods of controlling and attaching electronic and electrified devices are needed.

BRIEF SUMMARY

The following summary is provided to facilitate an understanding of some of the innovative features unique to the present invention and is not intended to be a full description. A full appreciation of the various aspects of the embodiments disclosed herein can be gained by taking the entire specification, claims, drawings, and abstract as a whole.

It is therefore an aspect of the embodiments to have a firearm handguard having and inner section and an outer section. The inner section can attach to the firearm in a manner similar to those presently used for handguards and forward rail systems. For example, present systems use the D-ring and forward cup, clamp to or attach to the standard barrel nut, or employ a non-standard barrel to attach the handguard. The outer section attaches to the inner section and is thereby also attached to the firearm.

The outer section contains devices and circuitry for controlling and powering a firearm accessory. For an embodiment can have a membrane switch on the outer surface of the outer section that controls the supply of electrical power to an empowered mounting rail. A device such as a laser designator or flashlight can be mounted to the empowered rail and thereby controlled by the membrane switch. In another embodiment the outer section includes the flashlight. In such an embodiment the outer section is attached to the inner section to provide the firearm with a flashlight.

It is a further aspect of the embodiments that a power supply is electrically connected to the outer section. Any electronic devices attached to or included in the outer section can be powered by the attached battery.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

A firearm can have a handguard having an inner section and an outer section with the outer section having circuitry and control devices for controlling electronic devices. The electronic devices can be part of the outer section. The inner section attaches to the firearm similarly to a current art handguard. The outer section attaches to the inner section. Different functionality can be obtained through the attachment of different outer sections to the inner section. The outer section can obtain electrical power from a power supply attached to or integrated with the firearm. The outer section can alternatively receive electrical power from a power supply carried by a person in a back pack or vest.

Figure 1:
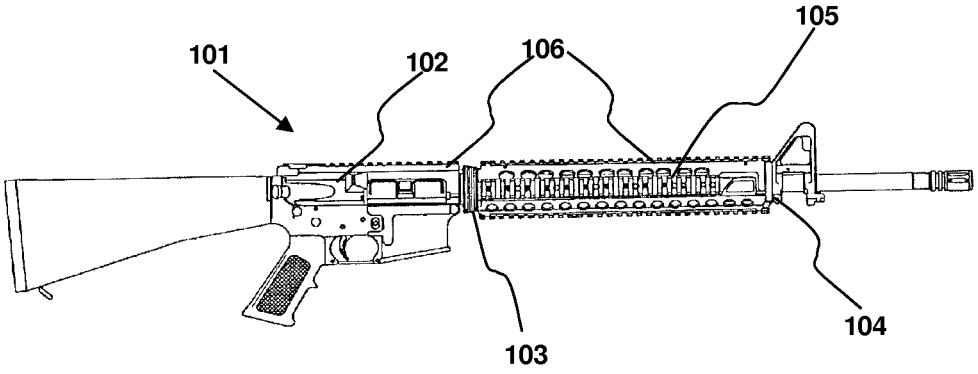
Fig. 1 (Prior Art)
FIG. 1, labeled as "Prior Art", illustrates an M16 type firearm with mounting rails.
Figure 2:
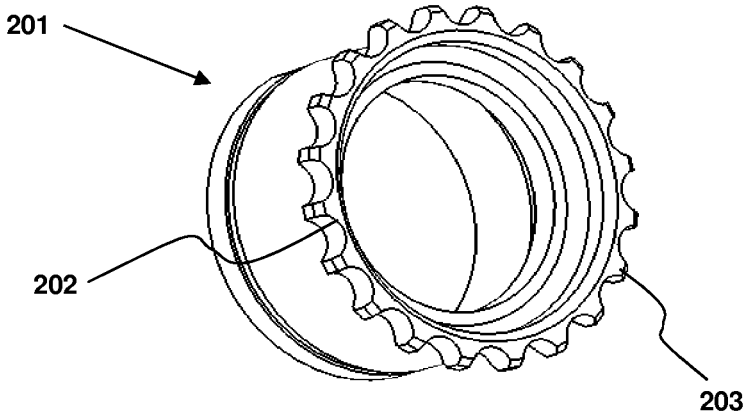
Fig. 2 (Prior Art)
FIG. 2, labeled as "Prior Art", illustrates a barrel nut having a barrel nut sprocket.
Figure 3:
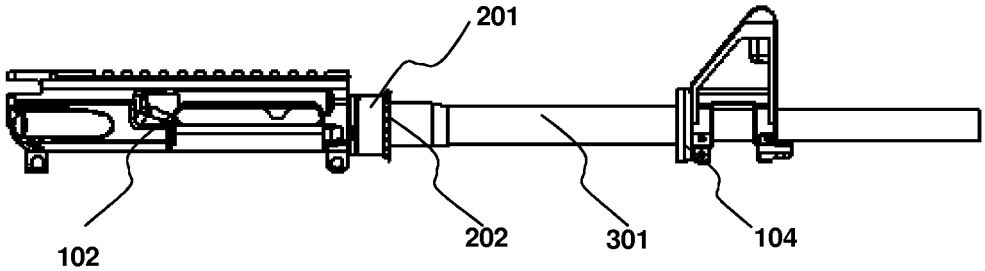
Fig. 3 (Prior Art)
FIG. 3, labeled as "Prior Art", illustrates a barrel nut attaching a barrel to a firearm receiver.
Figure 4:
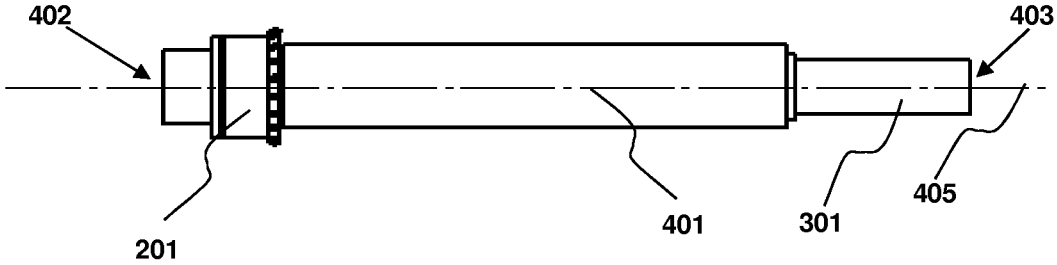
FIG. 4 illustrates an inner section 401 attached to a barrel nut 201 and free floated around a barrel in accordance with aspects of the embodiments

FIG. 4 illustrates an inner section 401 attached to a barrel nut 201 and free floated around a barrel 301 in accordance with aspects of the embodiments. The inner section can be clamped to the barrel nut or attached in some other manner. The barrel 301 has a breech 402 and a muzzle 403. A long axis 405 runs through the length of the barrel. A cylindrical inner section would run along the length of the barrel and the cylinder walls would circumferentially enclose both the barrel and the long axis.

Figure 5:
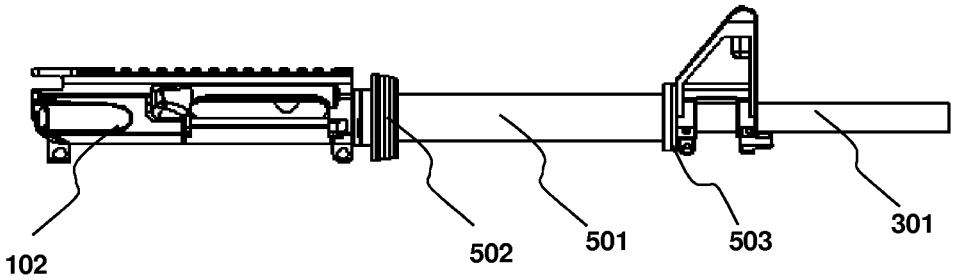
FIG. 5 illustrates an inner section attached to a firearm by a delta ring, aka B-ring, and front handguard cup in accordance with aspects of the embodiments.

FIG. 5 illustrates an inner section 501 attached to a firearm by a delta ring 502, aka d-ring, and front handguard cup 503 in accordance with aspects of the embodiments. This attachment is substantially identical to that used by the M16 for the past half century. Embodiments utilizing a d-ring attachment method are therefore likely to have a two part clam-shell arrangement such as the traditional M16. In fact, certain embodiments can employ an outer section that attaches to a traditional M16 handguard.

Figure 6:
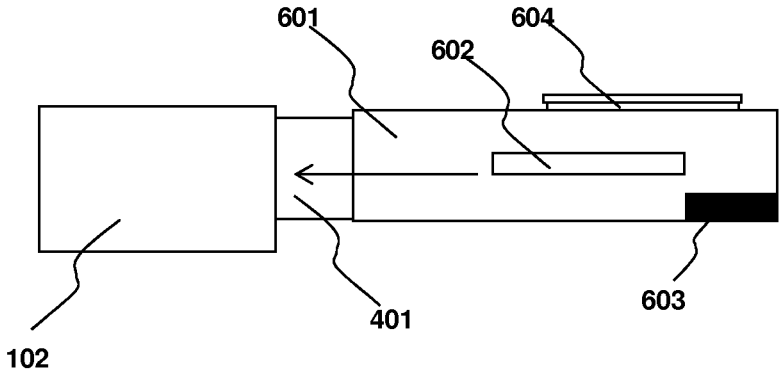
FIG. 6 illustrates an outer section partially slipped over an inner section in accordance with aspects of the embodiments.

FIG. 6 illustrates an outer section 601 partially slipped over an inner section 401 in accordance with aspects of the embodiments. The outer section incorporates a membrane switch 602 that an operator can use to control laser pointer 603. The circuitry that routes power and performs other desired functions is not shown because it is not visible. The circuitry can be on the inner surface of the outer section 601. The outer section 601 is illustrated as also having a non-powered mounting rail 604.

Figure 7:
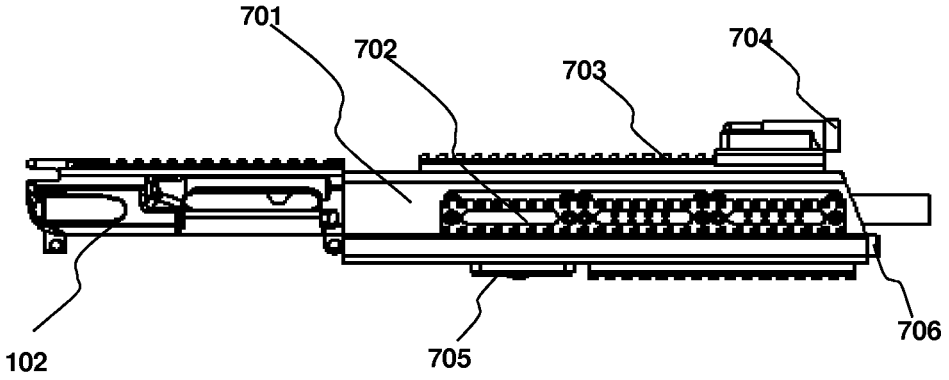
FIG. 7 illustrates an outer section attached to an inner section in accordance with aspects of the embodiments.

FIG. 7 illustrates an outer section 701 attached to an inner section in accordance with aspects of the embodiments. The outer section 701 can be slipped over the inner section and clamped, snapped over the inner section, or can be attached with fasteners such as bolts, set screws, or pins. A contact switch 702 can control a camera 704 attached to an empowered mounting rail 703. A slide switch 705 can control a colored light 706 incorporated in the outer section. The contact switch 702, slide switch 705, and membrane switch 602 of FIG. 6 are more generally referred to as herein as control devices.

Figure 8:
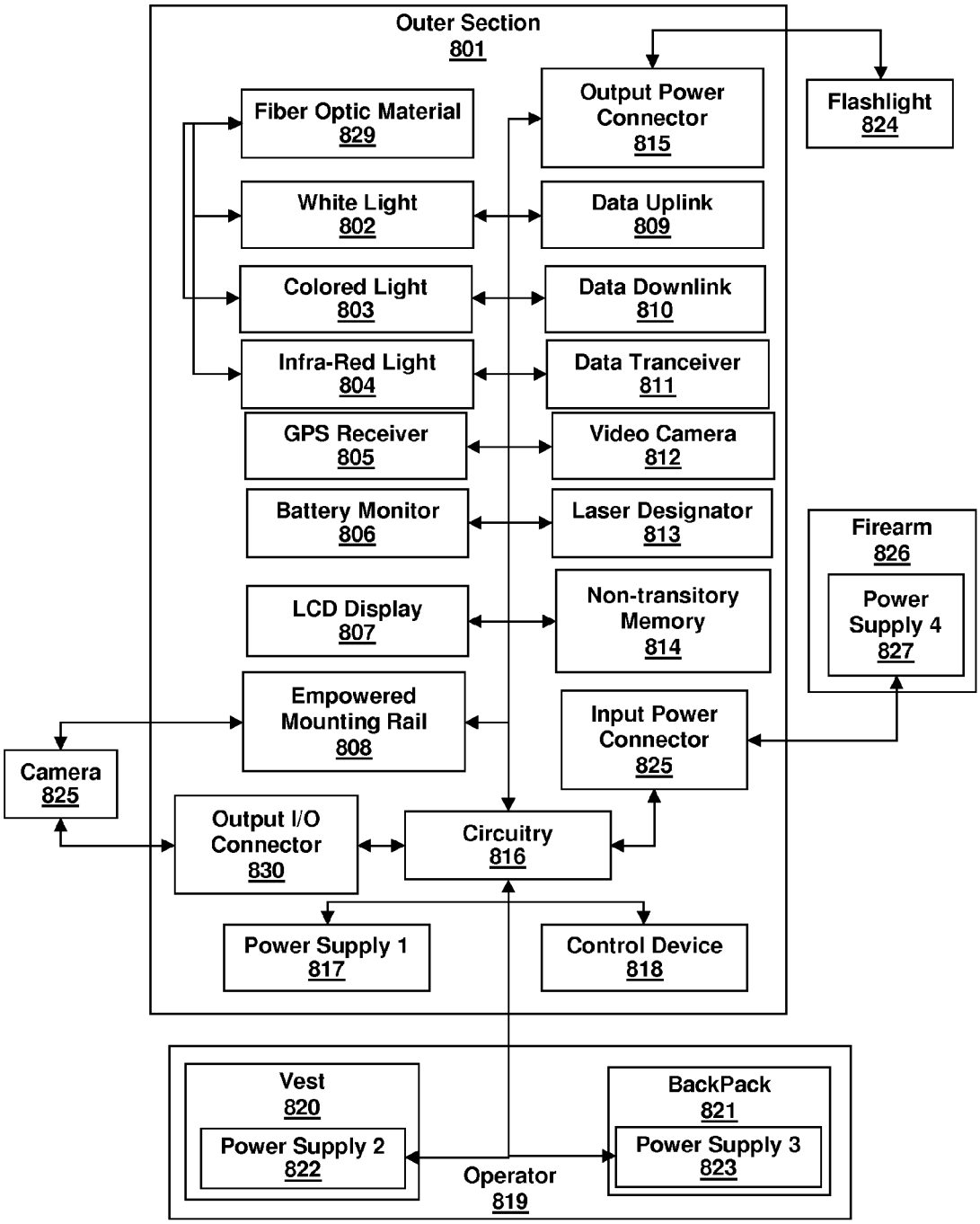
FIG. 8 illustrates an high level system diagram of an idealized outer section in accordance with aspects of the embodiments.

FIG. 8 illustrates an high level system diagram of an idealized outer section 801 in accordance with aspects of the embodiments. The outer section 801 is illustrated as incorporating a great number of devices. A white light 802 can produce white illumination. A colored light can produce colored light 803, such as red. An infra-red light 804 can produce infra-red light for night vision systems. The various lights can be coupled to fiber optic material 829 that routes the light to an output point.

A GPS receiver 805 can determine location information and can communicate that data to and through an LCD display 807, a data uplink 809, data transceiver 811, or other electronic device. The LCD display 807, data uplink 809, and data transceiver 811 are, in general, devices for relaying information to a person or to other electronic systems. A battery monitor 807 can check and report on the remaining charge or output voltage of power supplies such as power supply 1 817.

The data transceiver essentially combines the operation of the data uplink 809 and the data downlink 810. The difference being that the uplink and downlink are conceptually for long range, perhaps satellite, communication whereas a transceiver can be quite short range such as for Bluetooth, WiFi, or other networking technologies. The data communications devices can operate in cooperation with other devices such as the laser designator 813 or video camera 812. The video camera 812 can store video data in a non-transitory memory 814 like an SD card.

Circuitry 816 can route power, data, and control signals between the electronic devices. For example, the switches of FIGS. 6-7 are control devices 818 that direct the routing of power or on/off control signals.

The outer section 801 can obtain power from outside sources. Those sources include power supply 2 822 in an operator's vest 820, power supply 3 822 in the operator's backpack 821, and power supply 4 827 that is incorporated in or attached to the firearm 826. For example, power supply 4 827 can be inside the firearm butt stock. The external power supplies can route power to the circuitry 816 through an input power connector 825.

The outer section can also output power through an empowered mounting rail 808 or output power connector 815. For example, the circuitry routes power to output power connector 815 to thereby control flashlight 824. Similarly, camera 825 is mounted to empowered mounting rail 808. In addition camera 825 exchanges control and data signals with the circuitry 816 through output I/O connector 830.

Note that the empowered rails can be intentionally compatible with the currently available standard mounting rails. There are a number of different mounting rails standards. The United States defines the Picatinny rail with MIL-STD-1913 to be a standard small arms mounting rail. The Weaver rail is similar to the Picatinny rail with some accessories capable of using either the Picatinny or the Weaver. The North Atlantic Treaty Organization has at least two rail specifications (STANAG 2324 and STANAG 4694) for mounting rails that are largely compatible with the Picatinny. Yet another mounting rail somewhat compatible with the Picatinny is the "Canadian Weaver" that was developed by the Canadian Military. Other world militaries such as the Chinese military and the Russian military have similar standardized mounting rails. The important point here is that the powered rails can be dimensionally compatible with standardized mounting rails.

Figure 9:
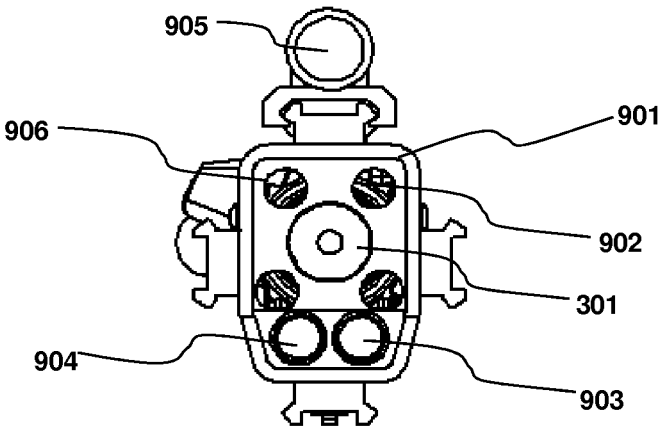
FIG. 9 illustrates a front view of a system having electronic devices attached to and incorporated in an outer section in accordance with aspects of the embodiments.

FIG. 9 illustrates a front view of a system having electronic devices attached to and incorporated in an outer section 901 in accordance with aspects of the embodiments. A camera 905 is attached to an empowered rail. An infra-red light 906, a laser 902, a colored light 903 and a white light 904 are incorporated into the outer section.

Figure 10:
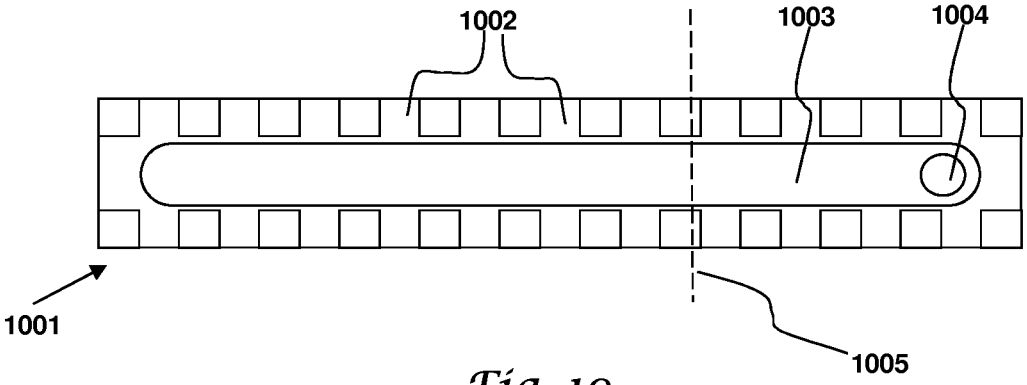
FIG. 10 illustrates a top view a mounting rail that can be empowered by the addition of a wiring harness in accordance with aspects of the embodiments.

FIG. 10 illustrates a top view a mounting rail 1001 that can be empowered by the addition of a wiring harness in accordance with aspects of the embodiments. The mounting rail 1001 is based on the well-known picatinny rail and can have recoil groves 1002 having the same center-to-center spacing, depth, and length as the picatinny rail. A channel 1003 cuts through the rail 1001 and recoil grooves 1002. As such the recoil grooves 1002 are cut along their width by the channel 1003. A cut line 1005 indicates a position for the cross sectional view of FIG. 12. The mounting rail 1001 can be empowered by drawing a wiring harness through hole 1004 and positioning the wiring harness in channel 1003. The wiring harness can have connectors, contact pads, sockets, or other means for providing electrical connections to electronic devices attached to the mounting rail 1001.

Figure 11:
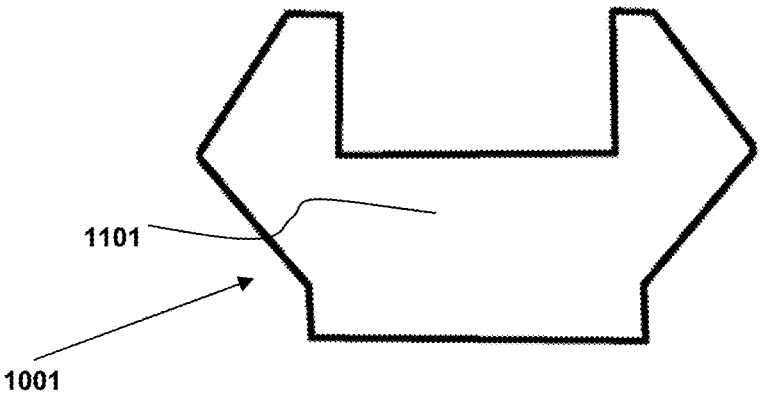
FIG. 11 illustrates an end view of the mounting rail of FIG. 10 accordance with aspects of the embodiments.
Figure 12:
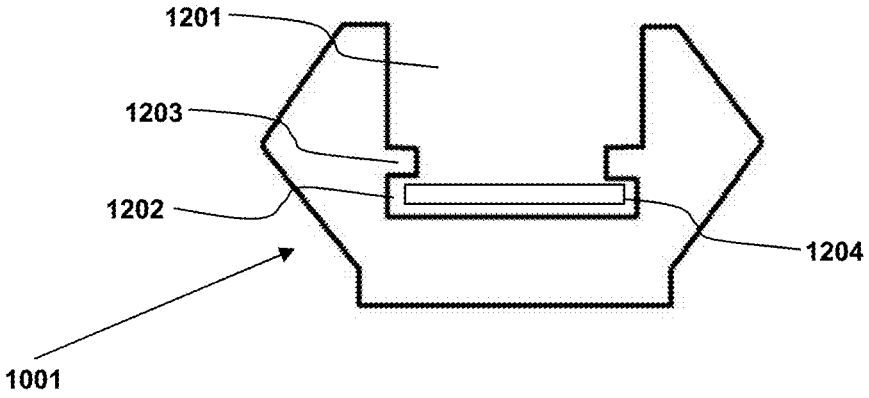
FIG. 12 illustrates an cross sectional view of the mounting rail of FIG. 10 accordance with aspects of the embodiments.

FIG. 11 illustrates an end view and FIG. 12 illustrates an cross sectional view of the mounting rail of FIG. 10 accordance with aspects of the embodiments. The channel 1003 of FIG. 10 can be seen to have an upper channel 1201 and a lower channel 1202 with a retention lip 1203 in between. The retention lip 1203 retains the wiring harness 1204 within the channel 1003. An end piece 1101 prevents the wiring harness 1204 from slipping lengthwise out of the chamber 1003. The illustrated wiring harness 1204 fits within the lower chamber. Other embodiments can provide wiring harnesses that extend into the upper chamber 1201 but that are still held by the retention lip.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A front handguard for a firearm wherein the firearm comprises a receiver and a barrel, the handguard comprising:

an inner section comprising an inner rear section wherein the inner section attaches to the firearm, wherein the inner rear section is adjacent to the receiver, wherein the inner section extends forward along the barrel, wherein the barrel comprises a breech, a muzzle, and a long axis wherein the long axis passes through the breech and the muzzle, wherein the inner section circumferentially encloses the long axis, wherein the firearm further comprises a D-ring, and wherein the D-ring attaches the inner section to the firearm; and an outer section comprising an electronic device wherein the outer section attaches to the inner section, wherein the inner section is between the outer section and the barrel; wherein the outer section comprises circuitry, wherein the circuitry comprises a control device operable by the user for controlling the electronic device, wherein a power supply electrically connected to the circuitry provides electrical power to the circuitry and to the electronic device.

2. The system of claim 1 wherein the barrel comprises a breech, a muzzle, and a long axis wherein the long axis passes through the breech and the muzzle, and wherein the inner section circumferentially encloses the long axis.

3. The system of claim 1 wherein the outer section circumferentially encloses the long axis.

4. The system of claim 3 wherein the outer section further comprises an empowered mounting rail that is empowered by receiving electrical power from the power supply, wherein the electronic device is attached to the empowered mounting rail and receives electrical power from the empowered mounting rail.

5. The system of claim 4 wherein the electronic device is or comprises a white light, a colored light, an infra-red light, a GPS receiver, a battery monitoring device, a laser designator, a camera, a non-transitory memory, a data uplink, a data downlink, a data transceiver, or an LCD display.

6. The system of claim 3 wherein the outer section further comprises a non-powered mounting rail and an output power connector wherein the electronic device is attached to the non-powered mounting rail and receives power from the output power connector.

7. The system of claim 1 wherein the outer section further comprises fiber optic materials.

8. The system of claim 1 wherein the firearm further comprises the power supply.

9. The system of claim 1 wherein the operator carries the power supply in a vest or backpack.

10. The system of claim 1 wherein the barrel comprises a breech, a muzzle, and a long axis wherein the long axis passes through the breech and the muzzle and wherein the outer section circumferentially encloses the long axis and the inner section.

11. A front handguard for a firearm wherein the firearm comprises a receiver and a barrel, the handguard comprising:

an inner section comprising an inner rear section wherein the inner section attaches to the firearm, wherein the inner rear section is adjacent to the receiver and wherein the inner section extends forward along the barrel; and an outer section comprising an empowered mounting rail that is empowered by receiving electrical power from a power supply, wherein the empowered mounting rail comprises a plurality of recoil grooves, wherein a channel passes lengthwise along the empowered mounting rail, wherein the channel bisects the recoil grooves, wherein a retention lip within the channel defines an upper channel and a lower channel, wherein a hole provides a passage way for a wiring harness to enter into the channel and wherein the retention lip retains the wiring harness within the chamber, wherein the outer section attaches to the inner section and wherein the inner section is between the outer section and the barrel; wherein the outer section comprises circuitry, wherein the circuitry comprises a control device operable by the user for controlling at least one electronic device, wherein the empowered mounting rail is configured to electrically powering and for removably attaching one of the at least one electronic device, wherein the power supply is electrically connected to the circuitry to thereby provide electrical power to the circuitry, to the empowered mounting rail, and thereby to the electronic device.

12. The system of claim 11 wherein the barrel comprises a breech, a muzzle, and a long axis wherein the long axis passes through the breech and the muzzle, wherein the inner section substantially encloses the long axis and wherein the outer section circumferentially encloses the long axis.

13. The system of claim 12 wherein the at least one electronic device comprises a second electronic device, wherein the outer section further comprises the second electronic device, and wherein the second electronic device receives power from the circuitry.

14. The system of claim 13 wherein the at least one electronic device comprises a white light, a colored light, an infra-red light, a GPS receiver, a battery monitoring device, a laser designator, a camera, a non-transitory memory, a data uplink, a data downlink, a data transceiver, or an LCD display.

15. The system of claim 14 wherein the firearm further comprises a barrel nut and wherein the inner section is attached to the firearm at the barrel nut and wherein the firearm further comprises the power supply.

16. The system of claim 14 wherein the firearm further comprises a barrel nut and wherein the inner section is attached to the firearm at the barrel nut and wherein the operator carries the power supply in a vest or backpack.

17. A front handguard for a firearm wherein the firearm comprises a receiver and a barrel, a handguard comprising:

an inner section comprising an inner rear section wherein the inner section attaches to the firearm, wherein the inner rear section is adjacent to the receiver, wherein the inner section extends forward along the barrel, wherein the barrel comprises a breech, a muzzle, and a long axis wherein the long axis passes through the breech and the muzzle, wherein the inner section circumferentially encloses the long axis, wherein the firearm further comprises a barrel nut and wherein the inner section is attached to the firearm at the barrel nut; and an outer section comprising an electronic device wherein the outer section attaches to the inner section, wherein the inner section is between the outer section and the barrel; wherein the outer section comprises circuitry, wherein the circuitry comprises a control device operable by the user for controlling the electronic device, wherein a power supply electrically connected to the circuitry provides electrical power to the circuitry and to the electronic device.

* * * * *